US005727875A

United States Patent [19]

Huang

[11] Patent Number: 5,727,875

[45] Date of Patent: Mar. 17, 1998

[54] DUAL-FUNCTIONAL LAMP

[76] Inventor: Ming-Kun Huang, 8F-6, No. 100, Sec. 2, Hoping E. Road, Taipei, Taiwan

[21] Appl. No.: 760,752

[22] Filed: Dec. 5, 1996

[51] Int. Cl.[6] ..... F21S 1/12

[52] U.S. Cl. ..... 362/414; 362/301; 362/322; 362/282

[58] Field of Search ..... 362/301, 410, 362/414, 431, 322, 282

[56] References Cited

U.S. PATENT DOCUMENTS 4,994,946 2/1991 Nakamats ..... 362/410

*Primary Examiner*—Carroll B. Dority

[57] ABSTRACT

A dual functional lamp is provided wherein a mirror base having a reflective mirror is disposed above the shade of the lamp. The mirror base is connected to the supporting bracket. The mirror base can be suitable adjusted such that the light emitted from the incandescent bulb can be reflected to a desired location to increase the luminance thereof, consequently the reader may read a book with sufficient luminance.

4 Claims, 5 Drawing Sheets

DUAL-FUNCTIONAL LAMP

FIELD OF THE INVENTION

The present invention relates to a dual functional lamp, more particularly, to a lamp having a reflective mirror wherein the light can be reflected downward to desired location to increase the luminance thereof.

DESCRIPTION OF PRIOR ART

As our living standard has been upgraded, lighting devices have played a great role in our daily life. Having suitable and elegant lighting device in our indoor decorations, not only will it bring sufficient luminance thereof, but will also provide an aesthetic appearance thereof. Accordingly, many an attempts have been provided to increase the function to the lamp, such as the wall fixture, pendant, desk lamp, floor lamp and track lighting.

Referring to FIG. 1, a perspective view showing a floor lamp thereof. The floor lamp includes a base 10, supporting bracket 11, light shade 12, and incandescent bulb 13. The supporting bracket 11 is disposed at the base 10 at one end. The other end of the supporting bracket 11 is disposed with a light shade 12 which opens upward. A incandescent bulb 13 is disposed within the shade 12.

Nevertheless, in the conventional floor lamp, the light beam emitted from the incandescent bulb 12 is projected upward which results poor luminance in the location beneath. If the owner would like to read a book under the floor lamp, it is very hard for the reader to read the book in such a dim area. Normally, another lighting device shall be applied which is really inconvenient.

SUMMARY OF THE INVENTION

It is the object of this invention to provide a floor lamp having a reflective mirror wherein the light can be reflected downward to desired location to increase the luminance thereof.

In order to achieve the object set forth, a dual functional floor lamp is provided, which includes a mirror base above the shade of the lamp. A reflective mirror is disposed at the mirror base. The mirror base is connected to the supporting bracket with a linkage which includes a fixed linking rod and an adjusting linking rod. The fixed linking rod is attached to the supporting bracket at one end and the adjusting linking rod is pivotally attached to the free end of the fixed linking rod. The free end of the adjusting linking rod is disposed with a ball to be pivotally engaged with a socket disposed at back side of the mirror base. With a suitable adjustment of the mirror base, the light emitted from the incandescent bulb can be reflected to a desired location to increase the luminance thereof such that the reader may read a book with sufficient luminance.

BRIEF DESCRIPTION OF THE DRAWINGS

In order that the present invention may more readily be understood the following description is given, merely by way of example with reference to the accompanying drawings, in which.

BRIEF DESCRIPTION OF NUMERALS

| | | | |
|---|---|---|---|
| 10 | base | 11 | supporting bracket |
| 12 | light shade | 13 | incandescent bulb |
| 14 | mirror base | 15 | mirror |
| 16 | linkage | 16a | fixed linking rod |
| 16b | adjusting linking rod | 16c | ball |
| 16d | socket | | |

DETAILED DESCRIPTION OF PREFERRED EMBODIMENT

Figure 1:
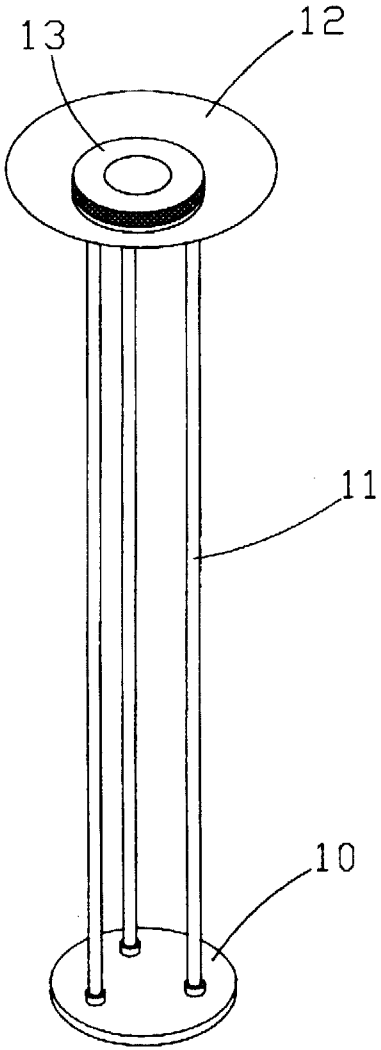
FIG. 1 is a perspective view of a conventional floor lamp.
Figure 2:
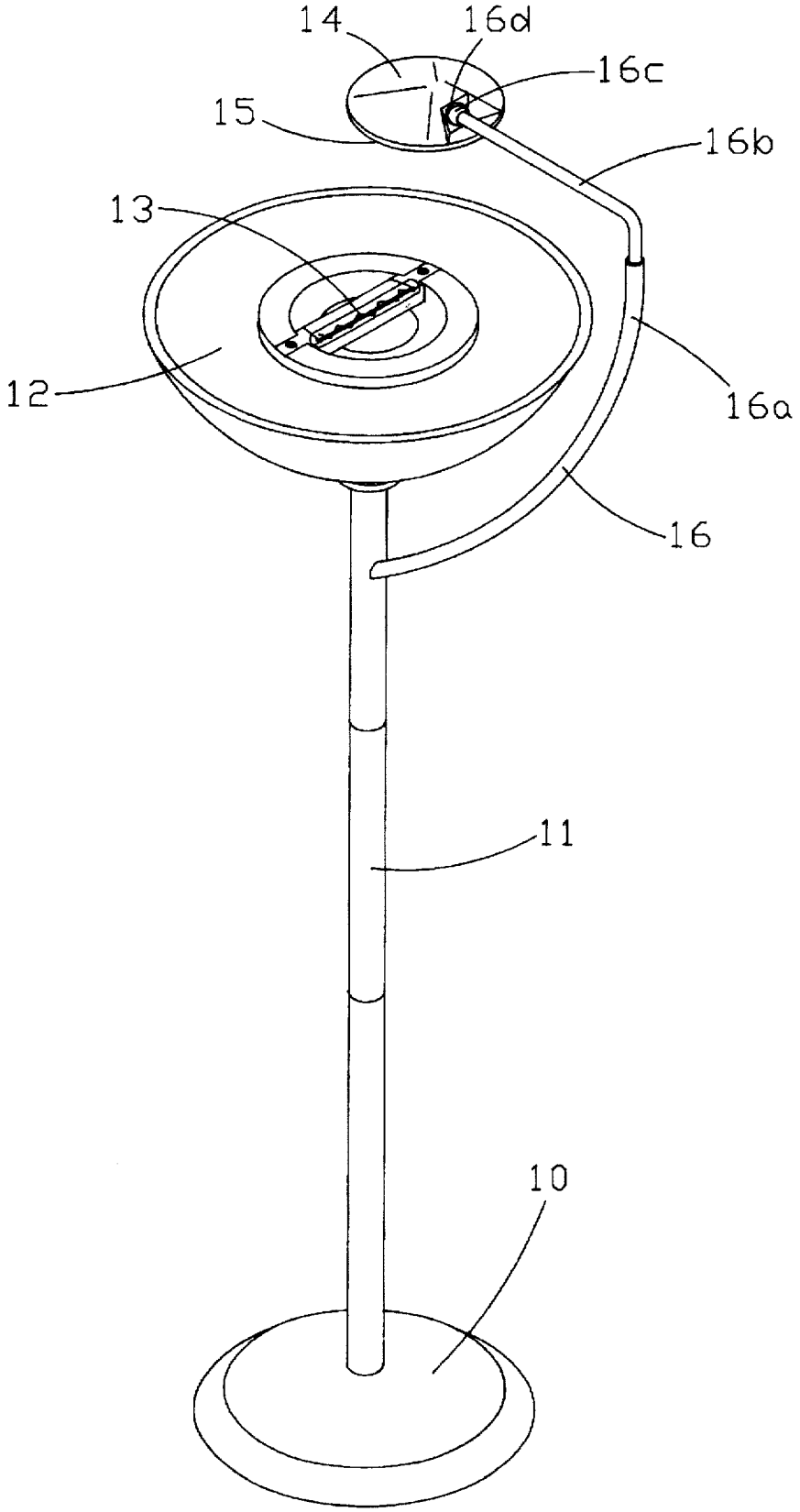
FIG. 2 is a perspective view of the floor lamp made according to this invention.
Figure 3:
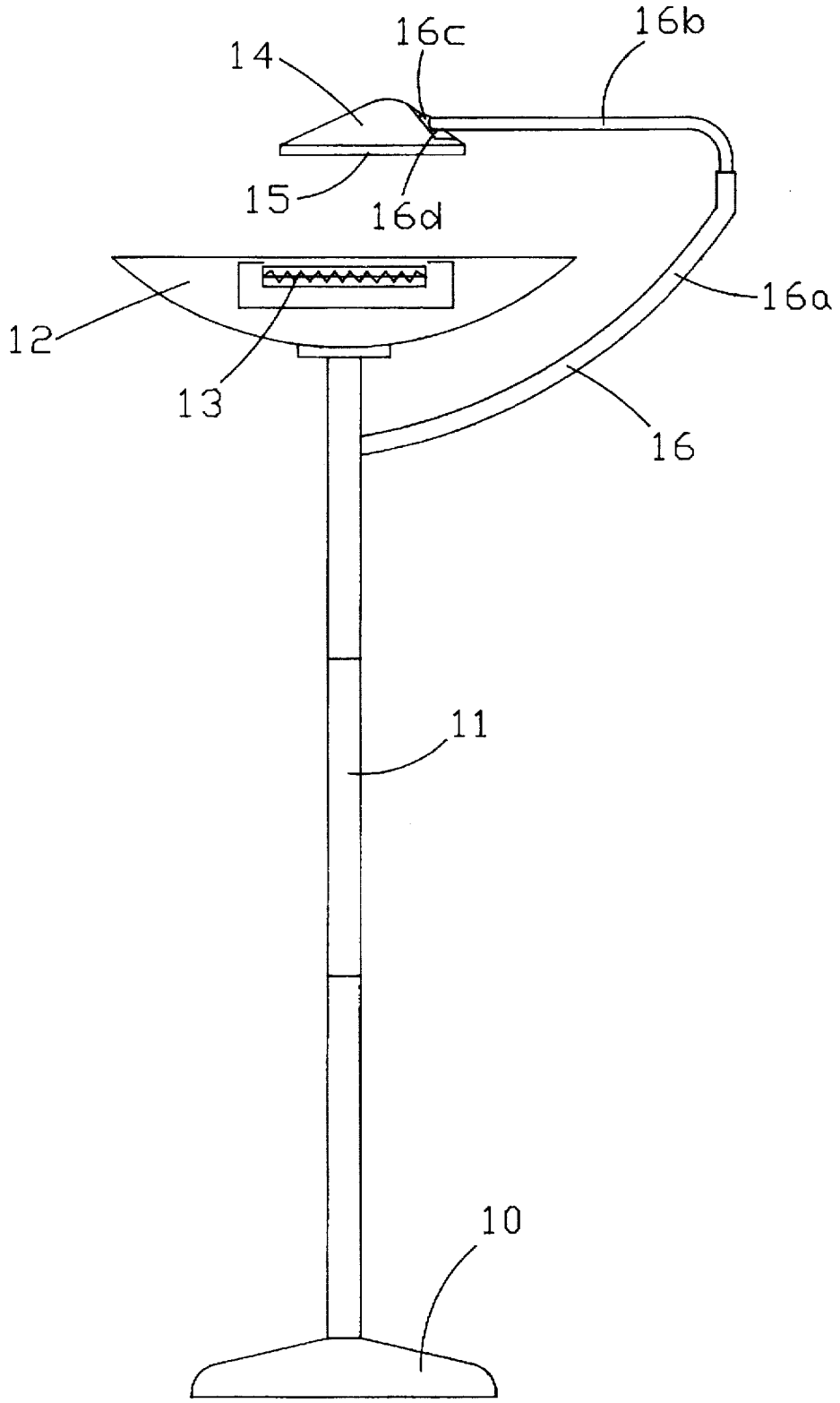
FIG. 3 is a plan view of the floor lamp made according to this invention.

Referring to FIGS. 2 and 3, a perspective and plan views are respectively shown. The floor lamp made according to this invention generally comprises a base 10, supporting bracket 11, light shade 12, incandescent bulb 13. The supporting bracket 11 is disposed at the base 10 at one end. The other end of the supporting bracket 11 is disposed with a light shade 12 which opens upward. A incandescent bulb 13 is disposed within the shade 12. The general configuration is identical to a conventional floor lamp, accordingly, no detailed description is made.

According to one aspect of this invention, a dual functional floor lamp is provided, which includes a mirror base 14 above the shade 12 of the lamp. A reflective mirror 15 is disposed at the mirror base 14. The mirror base 14 is connected to the supporting bracket 11 with a linkage 16 which includes a fixed linking rod **16*a* and an adjusting linking rod 16*b*. The fixed linking rod 16*a* is attached to the supporting bracket 11 at one end. Alternatively, the fixed linking rod 16*a* can be attached to the shade 12 also. The adjusting linking rod 16*b* is pivotally attached to the free end of the fixed linking rod 16*a*. The free end of the adjusting linking rod 16*b* is disposed with a ball 16*c* to be pivotally engaged with a socket 16*d* disposed at back side of the mirror base 14. The adjusting linking rod 16*b* can be pivotally adjusted with respect to the fixed linking rod 16*a*. With a suitable adjustment of the mirror base 14, the light emitted from the incandescent bulb 13 can be reflected to a desired location to increase the luminance thereof such that the reader may read a book with sufficient luminance. In light of this, the light beam can be readily adjusted by the mirror base 14 and the adjusting linking rod 16*b* which pivotally mounted to the fixed linking rod 16*a***.

Figure 4:
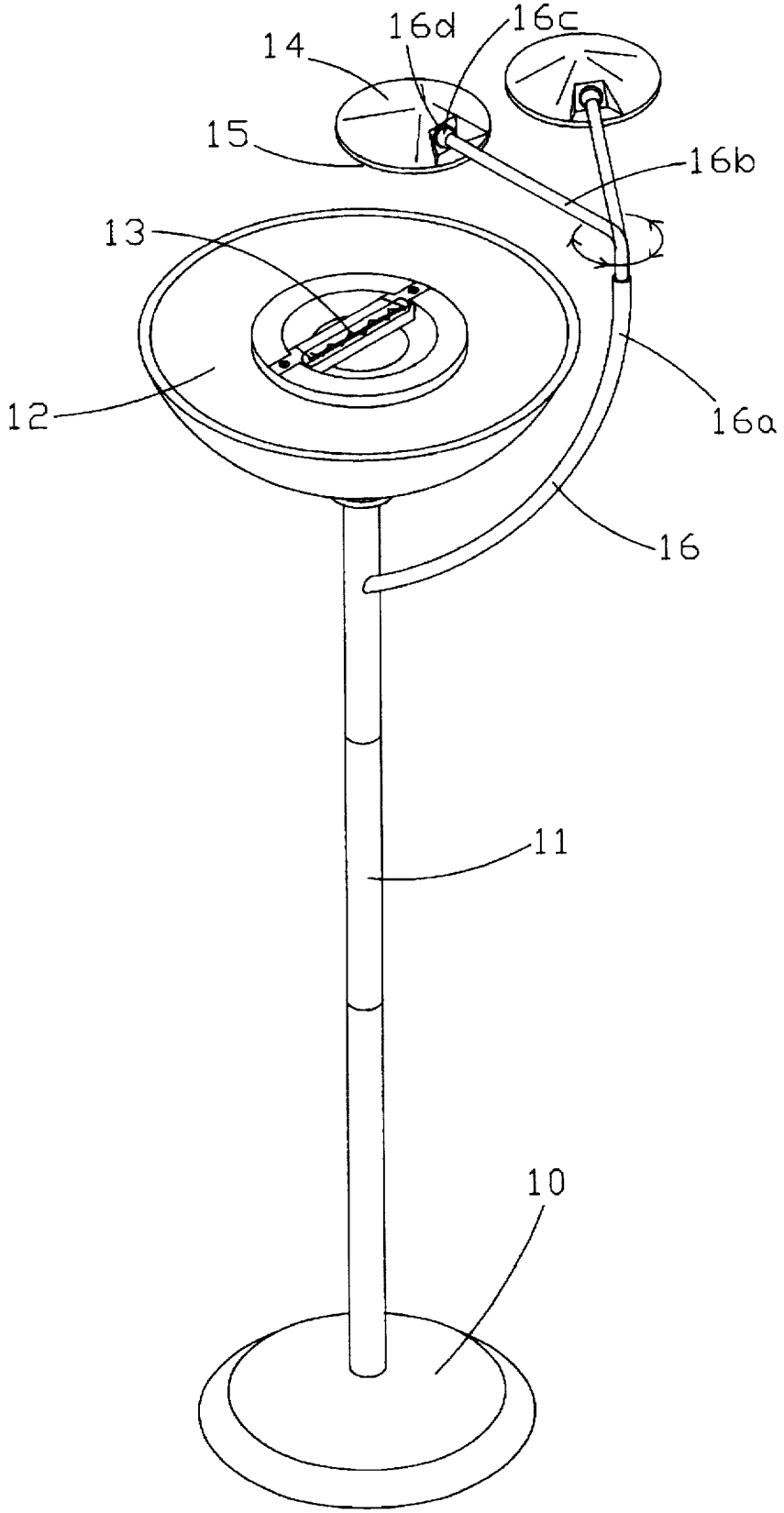
FIG. 4 is a schematic illustration showing the adjustment of the floor lamp made according to this invention.
Figure 5:
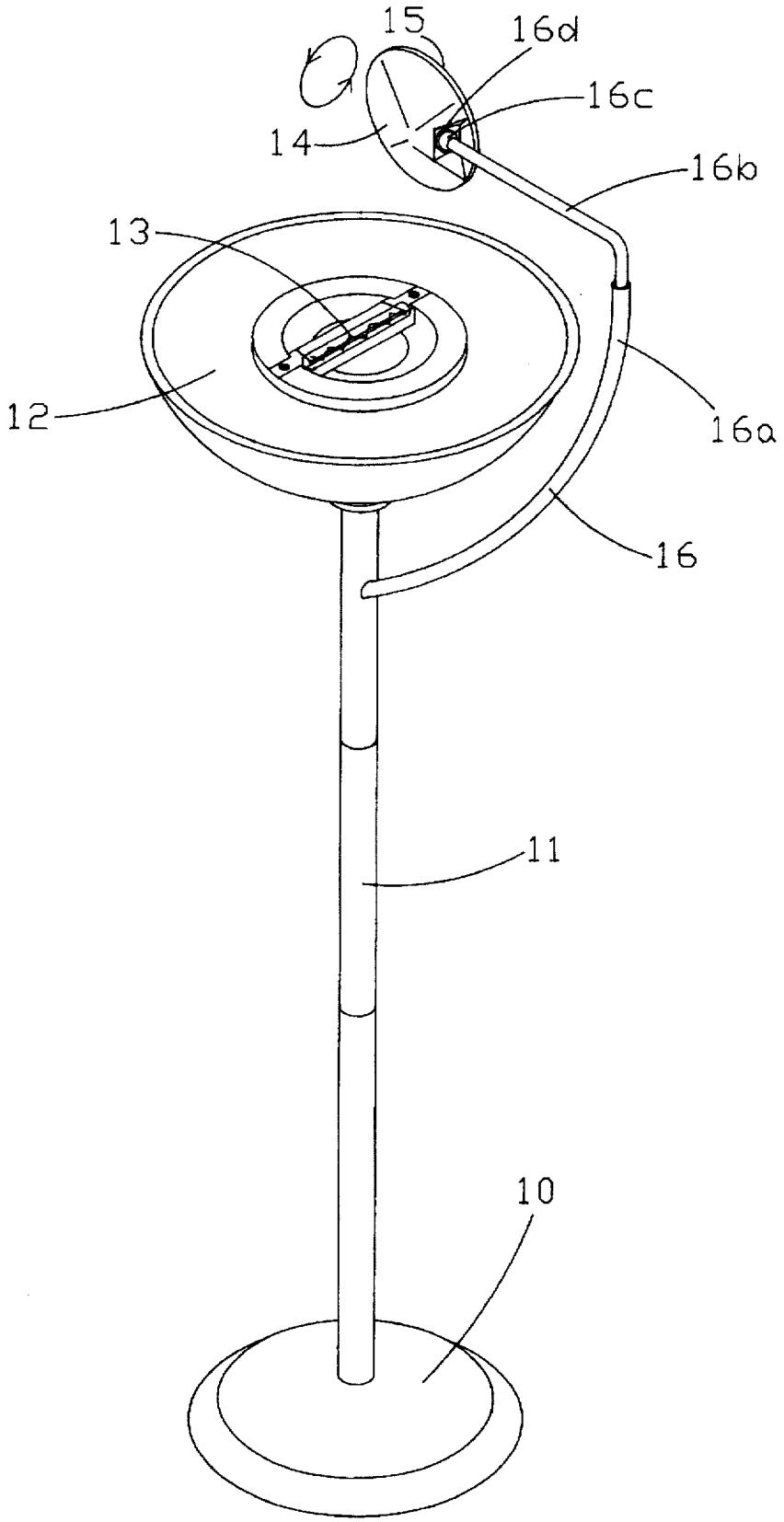
FIG. 5 is still a schematic illustration showing the adjustment of the floor lamp made according to this invention.

Referring to FIGS. 4 and 5, a schematic illustrations are respectively shown. The mirror base 14 can be pivotally adjusted centered on the ball **16*c* of the adjusting linking rod 16*b* of the linkage 16, clearly shown in FIG. 5. Accordingly, the mirror 15 on the mirror base 14 can be positioned at different angle such that the light emitted from the incandescent lamp 13 can be reflected and projected downward by the mirror 15 to a desired location which may have an enhanced luminance. Consequently, the user can read a book under this sufficient luminance projected by the reflective mirror 15**. In light of this, no additional lighting device is required. By the way, the light beam can be also projected to other position.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A dual functional lamp comprising a base, supporting bracket, light shade, and incandescent bulb, wherein said supporting bracket is disposed at said base at one end and the other end of said supporting bracket is disposed at said light shade which opens upward, an incandescent bulb being disposed within said shade:

characterized in that a mirror base having a mirror thereof is disposed above the shade, said mirror base being connected to said supporting bracket with a linkage which includes a fixed linking rod and an adjusting linking rod, said fixed linking rod being attached to either said supporting bracket or said light shade at one end and said adjusting linking rod being pivotally attached to an opposite end of said fixed linking rod and to said mirror which can be pivotally adjusted with respect to the free end of said fixed linking rod.

2. A dual functional lamp as recited in claim 1, wherein the lamp is a floor lamp.

3. A dual functional lamp as recited in claim 1, wherein said fixed linking rod is attached to said shade.

4. A dual functional lamp as recited in claim 1, wherein the free end of said adjusting linking rod is provided with a ball to be pivotally engaged with a socket disposed at opposite side of said mirror base from said mirror which can be pivotally adjusted with respect to said adjusting linking rod.

* * * * *